US009199298B2

(12) United States Patent
Bernardinis et al.

(10) Patent No.: US 9,199,298 B2
(45) Date of Patent: Dec. 1, 2015

(54) METHOD AND MACHINE FOR AUTOMATIC ASSEMBLY OF COMPLEX CAGES FORMED FROM ELECTRO-WELDED METAL NETS

(75) Inventors: Claudio Bernardinis, Buia (IT); Dimitris Theoharides, Athens (GR); Dimos Kalteziotis, Athens (GR)

(73) Assignee: A.W.M. S.p.A., Magnano in Riviera (IT)

( * ) Notice: Subject to any disclaimer, the term of this patent is extended or adjusted under 35 U.S.C. 154(b) by 176 days.

(21) Appl. No.: 13/509,297

(22) PCT Filed: Nov. 3, 2010

(86) PCT No.: PCT/EP2010/066672
§ 371 (c)(1),
(2), (4) Date: May 11, 2012

(87) PCT Pub. No.: WO2011/057923

PCT Pub. Date: May 19, 2011

(65) Prior Publication Data

US 2012/0222285 A1 Sep. 6, 2012

(30) Foreign Application Priority Data

Nov. 13, 2009 (IT) ..... UD2009A0201

(51) Int. Cl.
*B23P 11/00* (2006.01)
*B23Q 7/00* (2006.01)
(Continued)

(52) U.S. Cl.
CPC ..... *B21F 27/127* (2013.01); *B21F 27/121* (2013.01); *Y10T 29/49826* (2015.01); *Y10T 29/53991* (2015.01)

(58) Field of Classification Search
CPC ..... E04C 5/00; E04C 5/06; E04C 5/0604; E04C 5/0609; E04C 5/0613; B21D 47/00; B21D 51/00; B21D 51/06; B21F 27/127; B21F 27/121; Y10T 29/49826; Y10T 29/53991
USPC ..... 52/489.1, 742.13, 742.14, 745.19, 52/745.2, 122.1, 125.1, 125.3; 29/429, 29/430, 527.1, 559, 897.3, 897.33, 897.34
See application file for complete search history.

(56) References Cited

U.S. PATENT DOCUMENTS 3,245,189 A * 4/1966 Reiland ..... 52/649.3
3,604,180 A * 9/1971 Wood ..... 52/649.3
(Continued)

FOREIGN PATENT DOCUMENTS

EP 0 622 137 11/1994
EP 0 703 023 3/1996
(Continued)

OTHER PUBLICATIONS

International Search Report Issued Feb. 9, 2011 in PCT/EP10/66672 Filed Nov. 3, 2010.

*Primary Examiner* — Essama Omgba
*Assistant Examiner* — Darrell C Ford
(74) *Attorney, Agent, or Firm* — Oblon, McClelland, Maier & Neustadt, L.L.P.

(57) ABSTRACT

A method for the automatic and continuous construction and assembly of a complex three-dimensional reticular structure derived from electro-welded metal nets useable as reinforcements in concrete castings in anti-seismic construction projects, includes pre-assembling at least one cage in a zone located downstream of a folding assembly to allow continuous construction of the complex three-dimensional. The one cage is pre-assembled to include a structure that is folded one or more times. The method includes transporting the pre-assembled cage to the folding assembly for formation of an external enclosure cage. The method includes lifting the pre-assembled cage using automatic grippers from a sliding plane of an electro-welded metal net from which the external enclosure cage is to be folded, to allow the folding of the external enclosure cage and a definite closure thereof, thus encircling the pre-assembled cage with the folded external enclosure cage and forming the complex three-dimensional reticular structure.

10 Claims, 13 Drawing Sheets

(51) Int. Cl.

| | |
|---|---|
| ***B21B 13/22*** | (2006.01) |
| ***B23P 17/00*** | (2006.01) |
| ***B21D 47/00*** | (2006.01) |
| ***E04B 1/00*** | (2006.01) |
| ***E04G 21/00*** | (2006.01) |
| ***E04G 21/14*** | (2006.01) |
| ***B21F 27/12*** | (2006.01) |

(56) References Cited

U.S. PATENT DOCUMENTS

| | | | | | |
|---|---|---|---|---|---|
| 3,744,207 | A | * | 7/1973 | Oroschakoff | 52/664 |
| 3,838,484 | A | * | 10/1974 | Spencer | 29/897.34 |
| 4,000,923 | A | * | 1/1977 | Baldwin | 294/81.5 |
| 4,472,331 | A | * | 9/1984 | Kida | 264/31 |
| 4,726,708 | A | * | 2/1988 | Papetti | 405/19 |
| 4,838,726 | A | * | 6/1989 | Lucas Huerta | 403/397 |
| 4,897,953 | A | * | 2/1990 | Bruce | 43/102 |
| 4,911,209 | A | * | 3/1990 | Smith et al. | 140/112 |
| 5,333,970 | A | * | 8/1994 | Heselden | 405/286 |
| 5,392,580 | A | * | 2/1995 | Baumann | 52/660 |
| 5,412,905 | A | * | 5/1995 | Allison | 47/30 |
| 6,293,071 | B1 | * | 9/2001 | Konstantinidis | 52/659 |
| 7,421,827 | B1 | * | 9/2008 | Konstantinidis | 52/698 |
| 2002/0092475 | A1 | * | 7/2002 | Paynton et al. | 119/51.01 |
| 2004/0237449 | A1 | * | 12/2004 | Gulikov | 52/633 |
| 2005/0229536 | A1 | * | 10/2005 | Yoshii et al. | 52/783.11 |
| 2005/0257482 | A1 | * | 11/2005 | Galluccio | 52/649.2 |
| 2007/0084412 | A1 | * | 4/2007 | Eager | 119/51.03 |
| 2008/0156683 | A1 | * | 7/2008 | Heselden | 206/494 |
| 2009/0057533 | A1 | * | 3/2009 | Jung | 249/189 |
| 2009/0101610 | A1 | * | 4/2009 | Clark et al. | 211/113 |
| 2013/0008083 | A1 | * | 1/2013 | Weder et al. | 47/45 |
| 2013/0206506 | A1 | * | 8/2013 | Keersmaekers | 182/36 |
| 2014/0260037 | A1 | * | 9/2014 | Gulikov | 52/414 |

FOREIGN PATENT DOCUMENTS

| | | |
|---|---|---|
| GB | 1 587 993 | 4/1981 |
| JP | 6 226387 | 8/1994 |

* cited by examiner

METHOD AND MACHINE FOR AUTOMATIC ASSEMBLY OF COMPLEX CAGES FORMED FROM ELECTRO-WELDED METAL NETS

TECHNICAL FIELD

The present invention relates to a method for continuous manufacture and to the associated machine, or group of machines, for the automatic assembly of complex cages formed from orthogonal electro-welded metal nets, particularly useful in the implementation of automated systems for the formation of three-dimensional reticular structures for use as reinforcement structures for concrete castings in the construction sector in general, in prefabricated construction of buildings, or in anti-seismic construction of buildings.

The method and the associated machinery automatically optimise the operation—in cooperation and in coordination—of various mechanical assemblies, such as for example folder assemblies, manipulators and stopping areas for the initial formation of simple cages and/or of metal bars or rods, rectilinear and/or duly folded, which are subsequently inserted into one or more cages during the formation phase, i. e. the phase of enclosure, thus forming a complex reticular metal structure which is formed by a plurality of cages and/or bars. This complex product forms a single body that is adapted to be transported for subsequent processing or for immediate installation.

Thanks to known technologies in the automation sector, the invention is capable of continuously producing varied complex geometric configurations of cages, starting from flat electro-welded metal nets which are specifically folded, thus continuously forming simple individual structures which are then assembled together to form a single complex structure.

BACKGROUND ART

In the current state of the art, in the sector of automated systems for the formation of cages derived from electro-welded metal nets, i. e. in the construction of three-dimensional metal net structures with manual systems, the complex cages are produced manually in a phase subsequent to the automated production of the basic cages. Indeed, first the simple metal cages, which have any cross-sectional configuration, are constructed automatically; then they are transported to special assembly areas where operators manually bring them together, and bond them or weld them, thus forming a complex structure.

All this involves more manufacturing time, since the formation of complex cages does not take place with automated systems but with the manual intervention of operators who proceed with the assembly in areas that are separate from the system for producing the cages. Ultimately, it results in higher production costs and at the same time it requires greater use of areas which could be used for other purposes.

The present invention therefore intervenes in an advantageous manner, by greatly reducing the continuous manufacture times of complex cages, consequently avoiding the subsequent manual operations and the use of further factory floor space.

OBJECT OF THE INVENTION

The aim of the present invention is therefore to provide a method and the associated intelligent machine for the automatic and continuous manufacture of complex three-dimensional reticular structures, derived from a plurality of basic cages formed by electro-welded metal nets and/or metal bars folded for this purpose, that has the following principal characteristics:

- the automatic system for the formation of flat electro-welded metal nets is provided with an intelligent programming system for the production of reticular cages of any geometric configuration of cross-section and size, capable of producing (in a first phase) small structures, which are temporarily parked downstream, and (in a second phase) of producing a large and open three-dimensional reticular structure that is adapted to accommodate and contain the structures that were previously produced, finally closing them and enclosing them into each other, thus forming a complex structure, entirely automatically and without human intervention;
- the machine that carries out the method described above is governed by known computerised control systems and is composed of a bidirectional folding assembly that is capable of executing the folding of the electro-welded metal net in both directions, right-hand and/or left-hand; an intelligent trolley for the transport and correct positioning of the cage being constructed downstream of the folder assembly, that cooperates in coordination with it and is provided with a plurality of automatic grippers for gripping; a trolley similar to the previous one, positioned upstream of the folding assembly; a temporary downstream parking area; a final evacuation assembly; and lastly, a plurality of assemblies that can be moved on an overhead level and are provided with automatic grippers to serve all the assemblies previously described.

DISCLOSURE OF THE INVENTION

The objectives of the invention are achieved according to the characteristics of the main claim and/or of any other claim contained in this patent text, by means of devising a method and the associated machine or group of machines for the automatic assembly of complex metal reticular structures, formed by a plurality of simple cages that have any shape and size, and/or by rectilinear and/or folded metal bars.

The invention essentially consists in a particular method for the automatic production of complex cages that are adapted to be used in construction, for example in the anti-seismic construction sector.

This method involves the construction of a complex metal reticular cage, starting from one or more simple cages that can have any shape and size and are identical with and/or different from each other, or simply starting from bars or partial nets, flat or folded, to be added for this purpose during the formation of the complex structure.

First of all the simple cages are made, which are then temporarily transported to a special parking area downstream and correctly positioned to be automatically manipulated later (in the final phase), leaving the folding zone free for the formation of a last cage for containment, or final enclosure. The base of the enclosure cage is formed (leaving it open), and at this point the simple cages that were constructed earlier and deposited downstream are inserted in the correct position; subsequently the formation of the enclosure cage is completed by enclosing the simple cages in it (in a stable manner), thus forming a single complex cage that is ready to be transported and/or installed.

The machinery necessary to automatically produce a complex cage comprises (in addition to the automatic computerised control system of the various assemblies): a bidirectional folding assembly for electro-welded metal nets, which is arranged at right angles to the direction of progress of the flat and horizontal electro-welded metal nets, and which is served upstream and downstream by two distinct trolleys for transporting the cages undergoing production from the folding assembly; a plurality of movable upper assemblies, each of which is equipped with a plurality of automatic grippers for transporting the formed cages, be they simple or complex, to serve an area for temporary parking and/or for evacuation which is located further downstream.

The invention is essentially based on the concept that the complex reticular cages for construction are constituted by a set of simple cages brought together and joined integrally by means of a bigger cage (called a total enclosure cage) that encloses it. To do this, first the simple cages are built and are temporarily parked downstream (so as not to interrupt the continuous production cycle); then these cages are inserted, during the construction phase of the enclosure cage when it is still open; finally, the enclosure cage is definitely closed, thus enclosing all the simple cages inside it in a stable manner.

The system is capable of producing continuously, i. e. automatically and without interruption, complex cages of various geometric shapes and sizes.

According to another characteristic of the present invention, the phase of construction of a three-dimensional complex structure can also comprise the insertion of rectilinear or folded bars, or parts of flat or folded nets, inside or outside the simple cages in such a way as to also be enclosed in the formation of the complex cage. The purpose of these bars or parts of folded nets is to vary the height of the insertion of the simple cages inside the enclosure cage that is undergoing production.

A variation of the present invention consists in the fact that the formation of complex cages formed by a plurality of electro-welded metal nets with particular shapes determines configurations with further levels of complexity; this is possible precisely because of their construction characteristic, insofar as they are not the traditional type with constant orthogonal meshes, but instead produced with precisely specified irregular orthogonal meshes, with bars or rods that run parallel to the direction of advancement of the production with some transverse bars affecting all or only part of the width. In this way a plurality of simple cages can be inserted inside the external enclosure cage and be made to penetrate each other.

Moreover, as noted above, the movable and sliding grippers above can be correctly and automatically positioned, being movable on the horizontal level precisely so as to allow the exact insertion of the simple cages, from the top, before the final closing with the enclosure cage which can be obtained from metal net with regular orthogonal meshes or with irregular orthogonal meshes.

Another advantageous variation of the present invention consists in the fact that more complex cages, constructed as described above, can in turn be included in other, bigger reticular enclosure cages.

A further advantageous variation of the present invention consists in the fact that the machinery for the formation of the complex reticular metal cages serves, downstream, an automatic system for the continuous formation of flat electro-welded metal nets with regular or irregular meshes, or it can also serve, downstream, an automatic movable feeder magazine provided with a plurality of trolleys for carrying electro-welded metal nets of various geometric shapes and/or sizes.

The invention therefore fully achieves the set aim, i. e. that of providing a system or a method that, with the aid of suitable machines provided with automatic and computerised controls, makes it possible to produce complex reticular metal cages starting from electro-welded metal nets with constant or inconstant meshes. Continuous production, without the use of intermediate parking zones outside the system itself, according to the basic principle which involves making the simple cages first, in order to insert them later inside the last cage during its formation and before its final closing. In this way a high-technology product is automatically manufactured that fully meets the requirements of the most advanced designs in the anti-seismic construction sector.

BRIEF DESCRIPTION OF THE DRAWINGS

These and other characteristics of the invention will become better apparent from the description of an embodiment, given as a preferred but non-limiting example, in the accompanying thirteen sheets of drawings, wherein.

Figure 1:
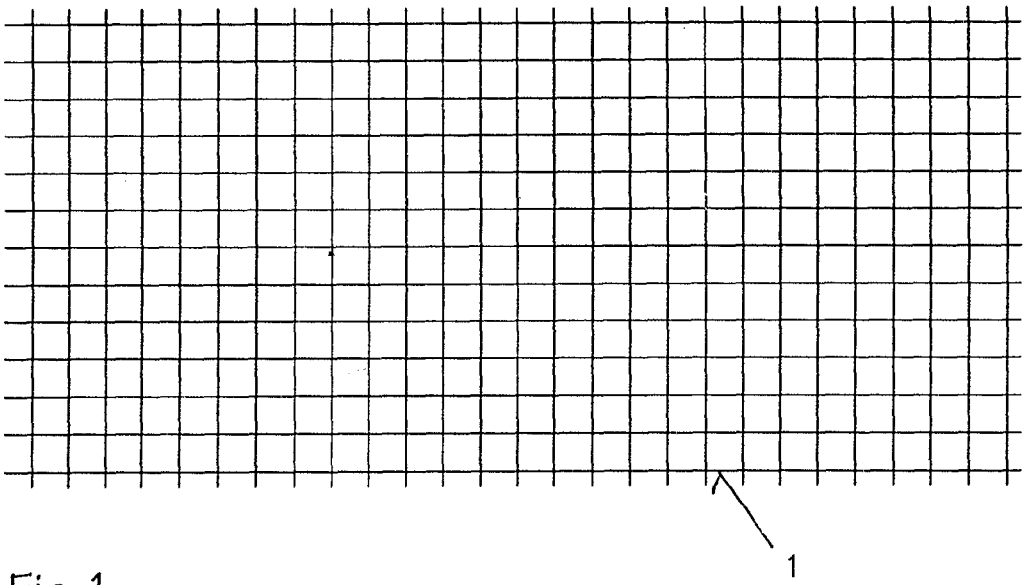
FIG. 1 shows, in a plan view, a flat electro-welded metal net of the traditional type with constant meshes, used (in the present invention) preferentially as the final enclosure net.
Figure 2:
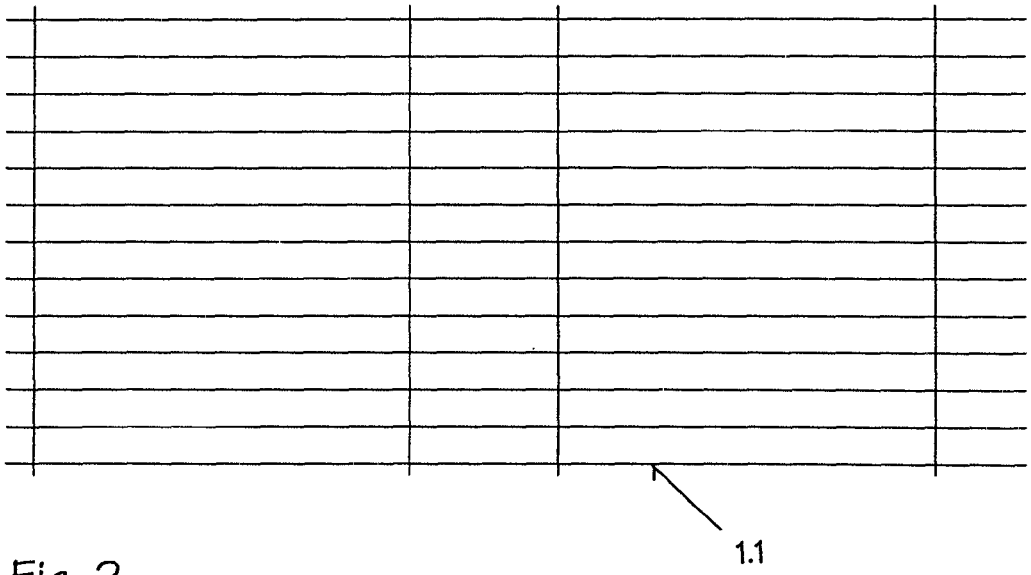
FIG. 2 shows, in a plan view, a flat electro-welded metal net with unequal meshes, used in the preferential construction of simple cages with the option of being interposed so as to be coupled to each other.
Figure 3:
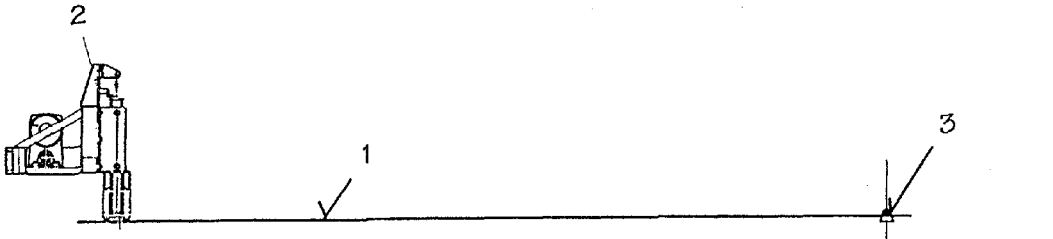
FIG. 3 shows, in a schematic end view, the first phase of positioning for the folding of an enclosure net in the construction of a complex reticular cage, with the use of the trolley positioned upstream of the folding assembly.
Figure 4:
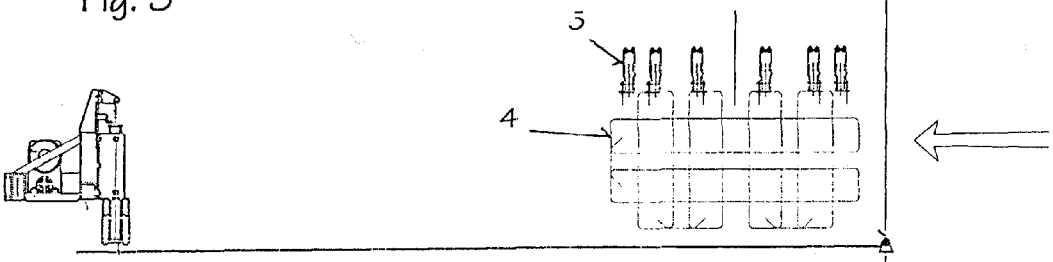
FIG. 4 shows, in a schematic side view, the second phase of the method with folding of the end of the net and the simultaneous insertion of the pre-assembled simple cages into position, which are transported and supported by the special movable overhead grippers.
Figure 5:
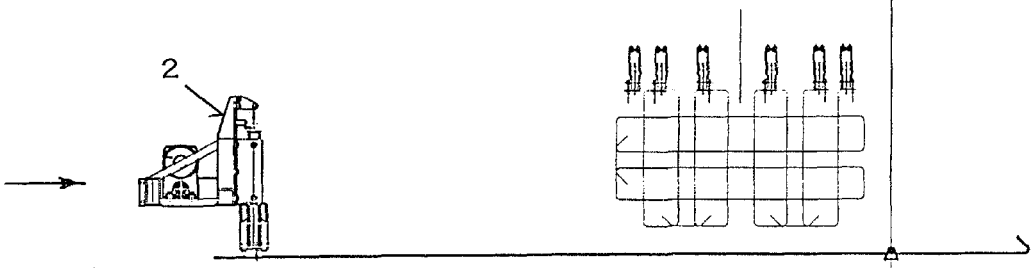
FIG. 5 shows, in a side view, the third phase of the construction method with the advancement of the trolley upstream of the folding assembly so as to be able to correctly position the net and then carry out the second folding of the enclosure net.
Figure 6:
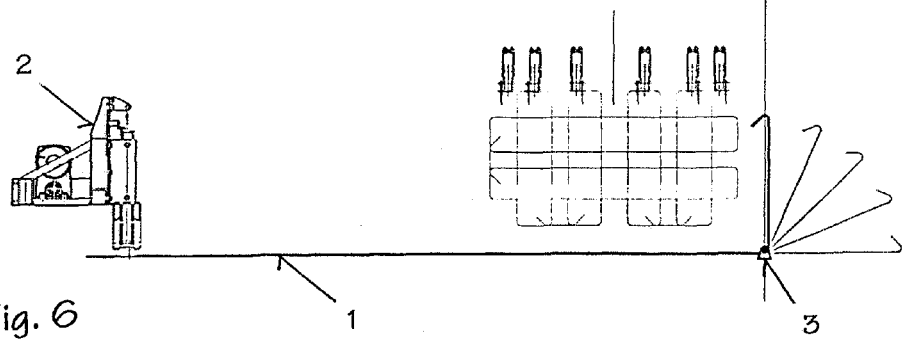
FIG. 6 shows, in a side view, the fourth phase i. e. the folding of the net, and thus production of the first side of the enclosure.
Figure 7:
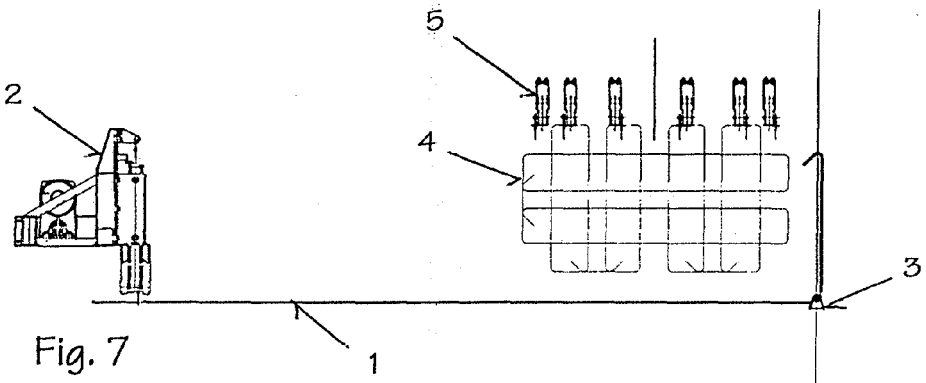
FIG. 7 shows, in a side view, the previous folding phase, completed.
Figure 8:
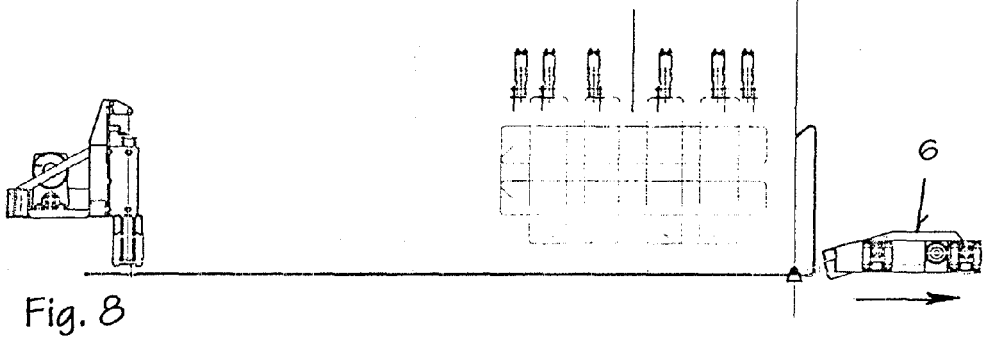
FIG. 8 shows, in a side view, the intervention of the second positioning trolley, which is downstream of the folding assembly and which grips the enclosure net.
Figure 9:
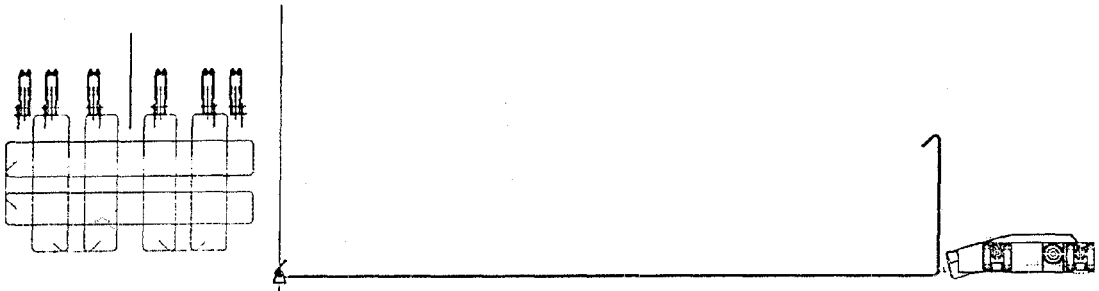
FIG. 9 shows, in a side view, the folding phase of the other end of the enclosure net.
Figure 10:
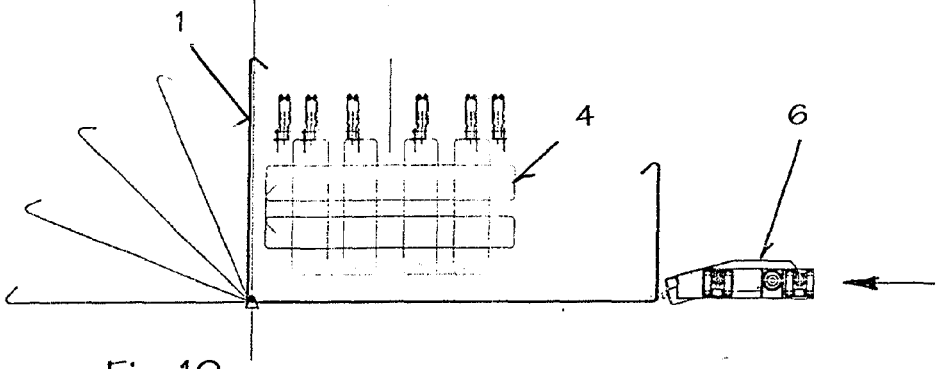
FIG. 10 shows, in a side view, the downstream trolley advanced to the folding assembly so as to be able to execute the folding of the last side of the enclosure.
Figure 11:
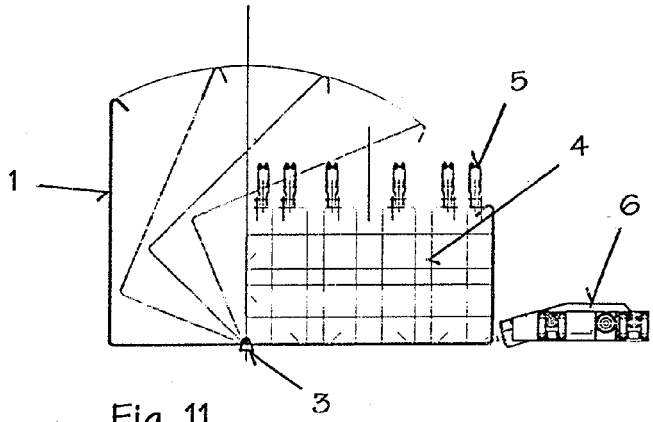
FIG. 11 shows, in a side view, the downstream trolley further advanced to the folding assembly so as to be able to execute the penultimate side of the enclosure, definitely closing the preassembled simple cages and in the process forming a complex reticular metal cage.
Figure 12:
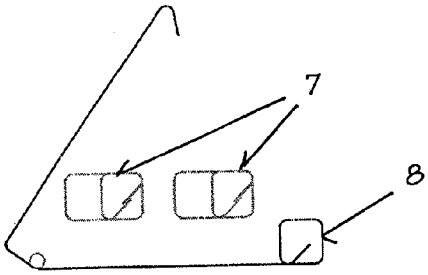
FIG. 12 shows, in a side view, a possible complex cage that is composed of two simple cages plus an external enclosure cage, with the penultimate side in the closing phase.
Figure 14:
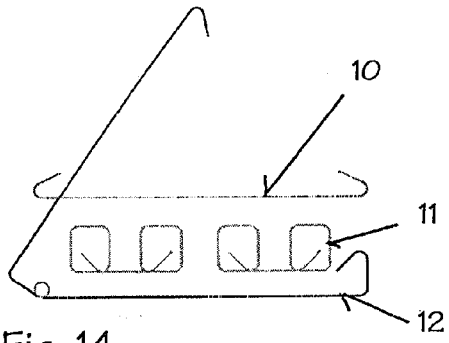
FIG. 14 shows, in a side view, a possible complex cage formed by two identical simple cages, with the insertion of a folded rod or net with irregular meshes, so as to lock into position the simple cages inside the external enclosure cage in the closing phase.
Figure 13:
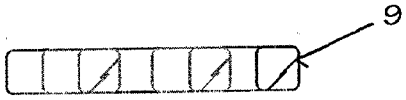
FIG. 13 shows, in a side view, the example of the complex cage in the previous figure with the closing completed.
Figure 15:
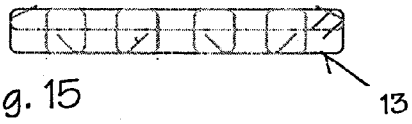
FIG. 15 shows, in a side view or cross-section view, the complex cage in the previous figure, completely finished.
Figure 16:
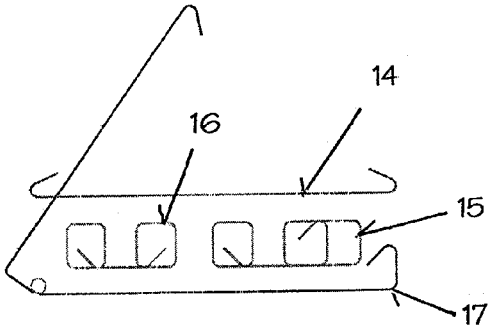
FIG. 16 shows, in a side view, another example of a complex cage formed by two different simple cages together with a rod or net with irregular meshes with the ends folded, before closing with the external enclosure net.
Figure 18:
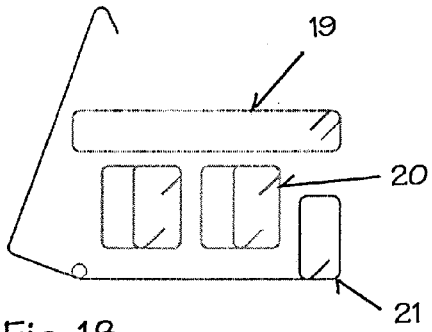
FIG. 18 shows, in a side view, another example of a complex reticular cage formed by three simple cages, two of which are identical and one is rectangular, before the closing phase of the enclosure cage.
Figure 17:
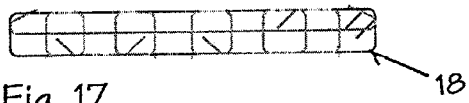
FIG. 17 shows, in a side view, the previous example of a complex cage, completed.
Figure 19:
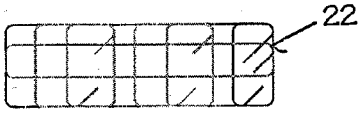
FIG. 19 shows, in a side view, the previous cage, completed.
Figure 20:
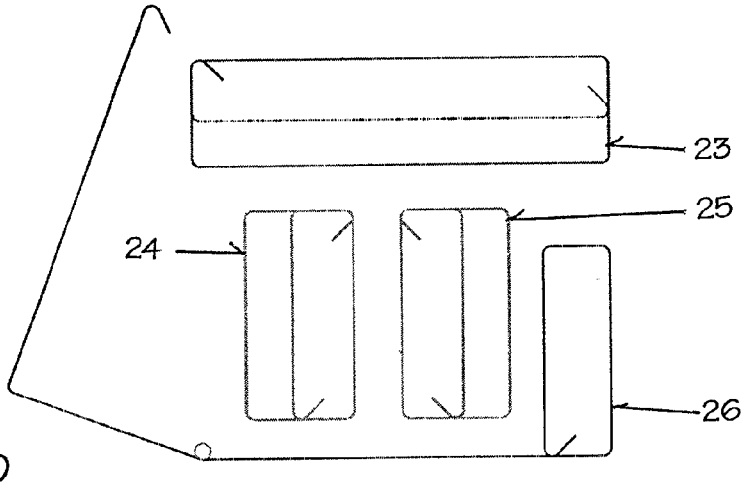
FIG. 20 shows, in a side view, another example of building a complex cage formed by three simple cages plus a cage that is included in the formation of the enclosure cage.
Figure 21:
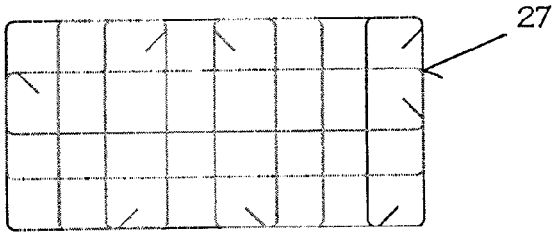
FIG. 21 shows, in a side view, the complex cage completely closed and finished.
Figure 22:
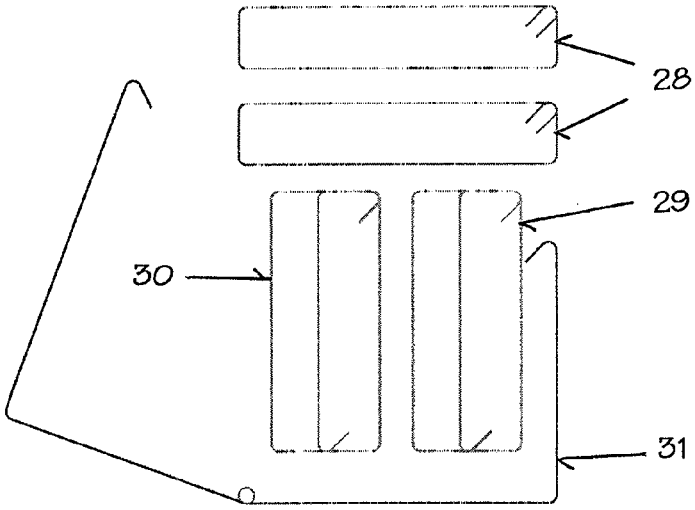
FIG. 22 shows, in a side view, another embodiment of a complex cage formed by four simple cages of different sizes, variously coupled to each other so as to determine a divided arrangement, plus the external enclosure.
Figure 23:
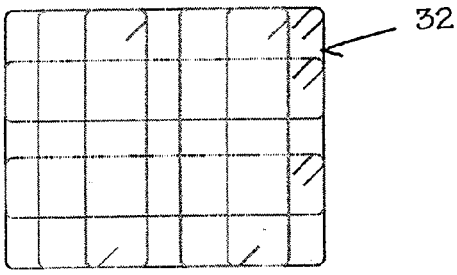
FIG. 23 shows, in a side view, the complex cage in the previous figure, completed.
Figure 24:
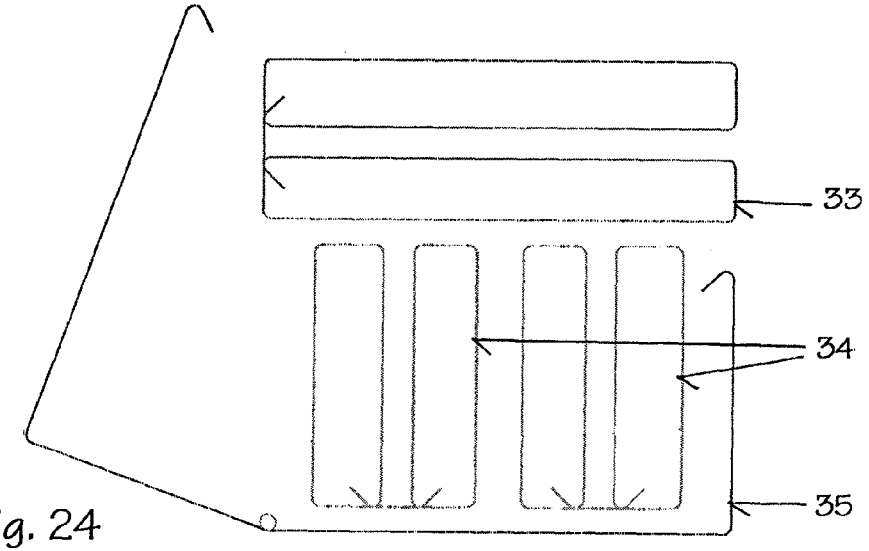
FIG. 24 shows, in a side view, another embodiment of a complex cage formed by three large simple cages, two of which are identical and one is bigger, which penetrate one another so as to be distributed across the entire section and then be enclosed by the external enclosure net.
Figure 25:
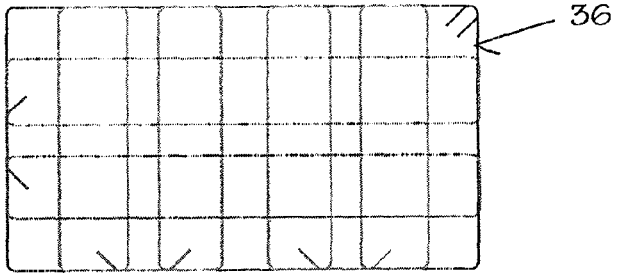
FIG. 25 shows, in a side view, the complex cage in the previous figure, completed.
Figure 26:
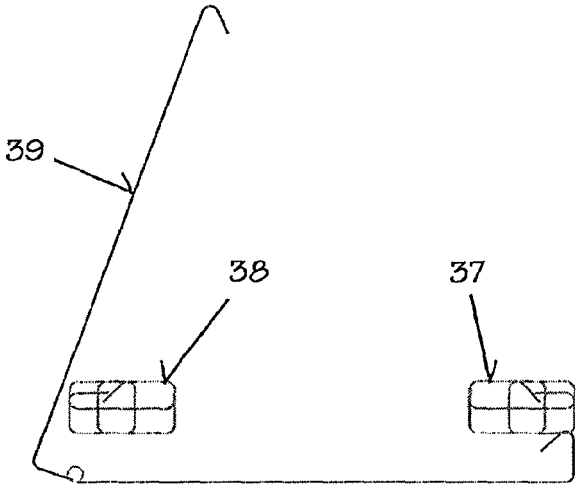
FIG. 26 shows, in a side view, a last embodiment of a complex cage formed by two pre-assembled simple cages of small size which are arranged spaced from each other inside the external enclosure net in the closing phase.
Figure 27:
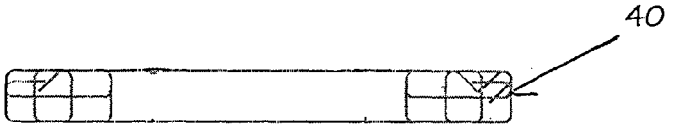
FIG. 27 shows, in a side view, the complex cage in the previous figure, completed.
Figure 28:
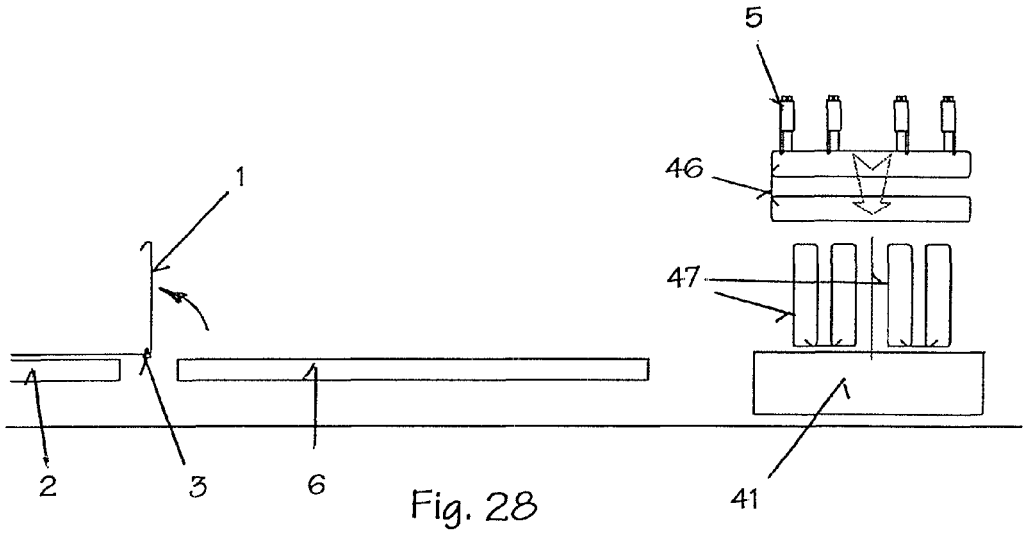
FIG. 28 shows, in a schematic side view, the pre-assembly zone downstream of the folding assembly which continues folding, while the insertion of the simple cages is carried out.
Figure 29:
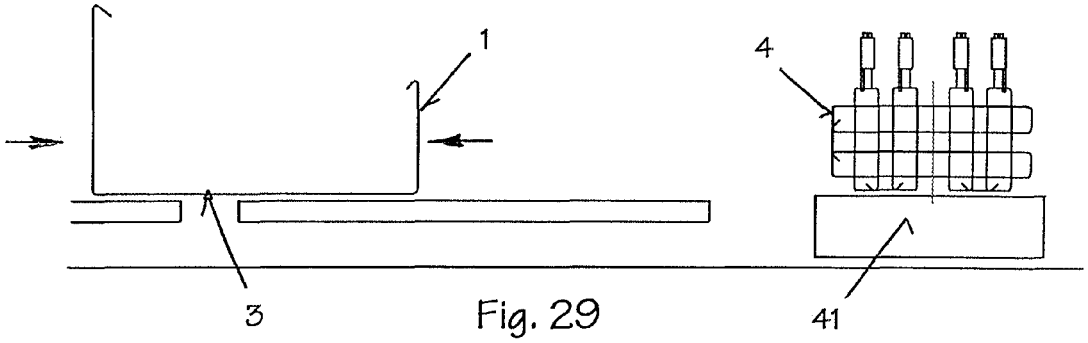
FIG. 29 shows, in a side view, the subsequent phase, i. e. the phase of the automatic grippers gripping the pre-assembled cages while the folding assembly continues working, served by the respective trolleys.
Figure 30:
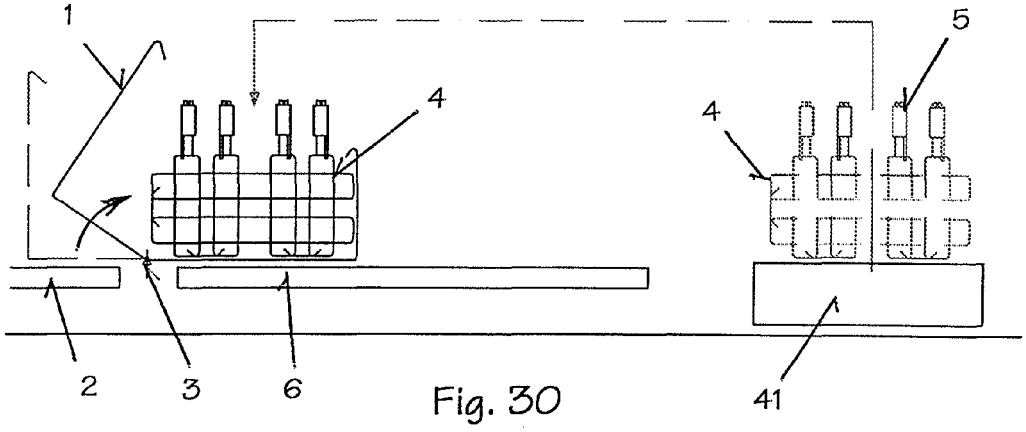
FIG. 30 shows, in a side view, the subsequent phase, i. e. the phase of transporting the pre-assembled cages and positioning them inside the enclosure cage in the final closing phase.
Figure 31:
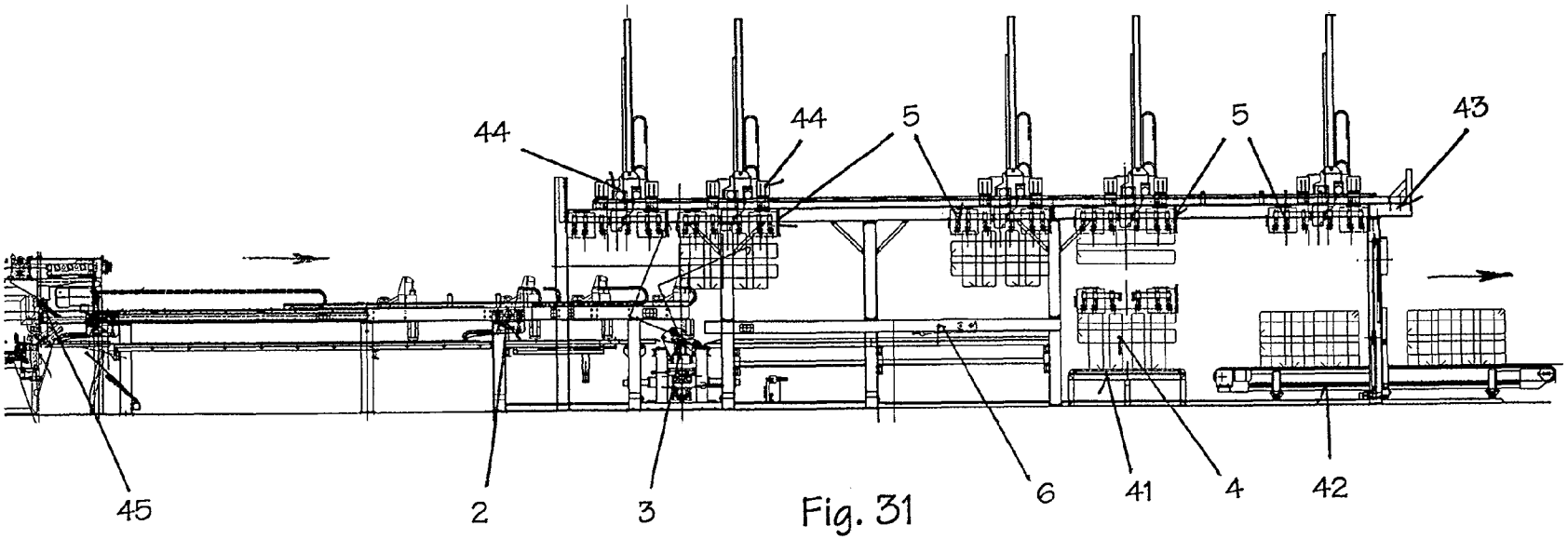
FIG. 31 shows, in a side view, the final part of the automated system for building complex cages derived from electro-welded metal nets with regular or irregular orthogonal meshes.
Figure 32:
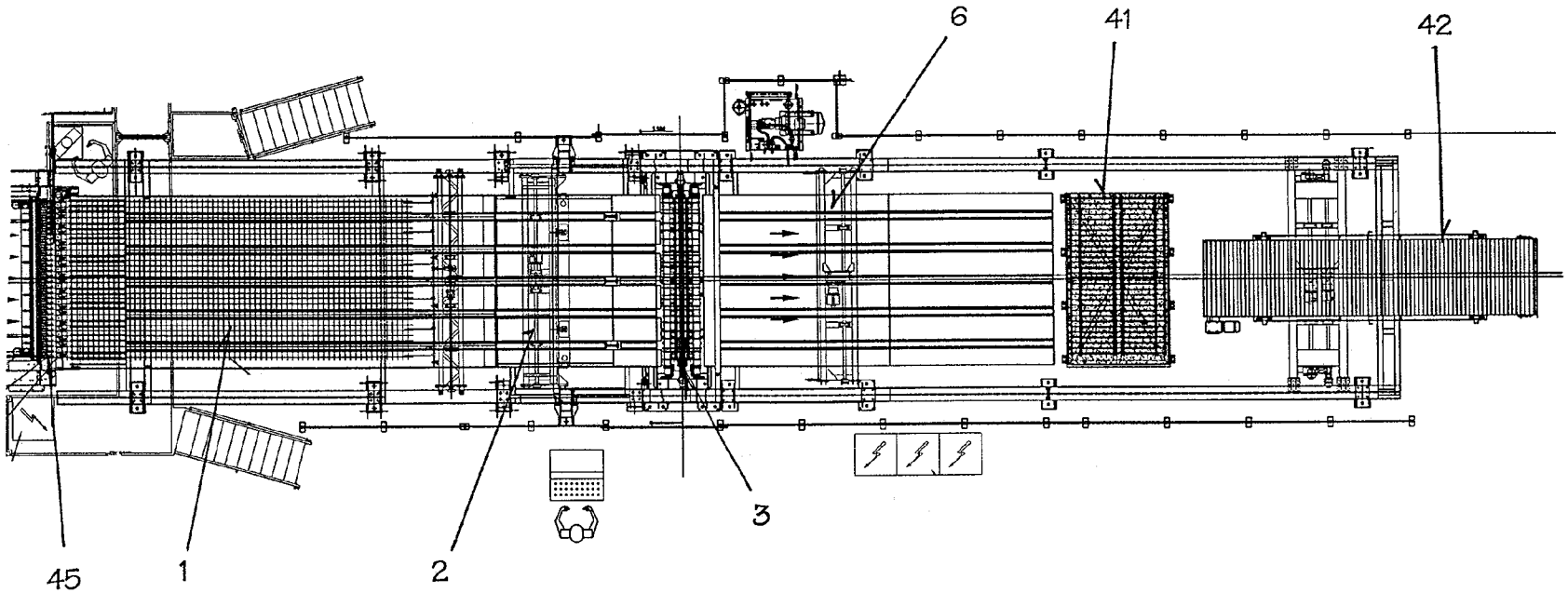
FIG. 32 shows, in a plan view, the final part of the system in the previous figure, for building complex reticular cages.
Figure 33:
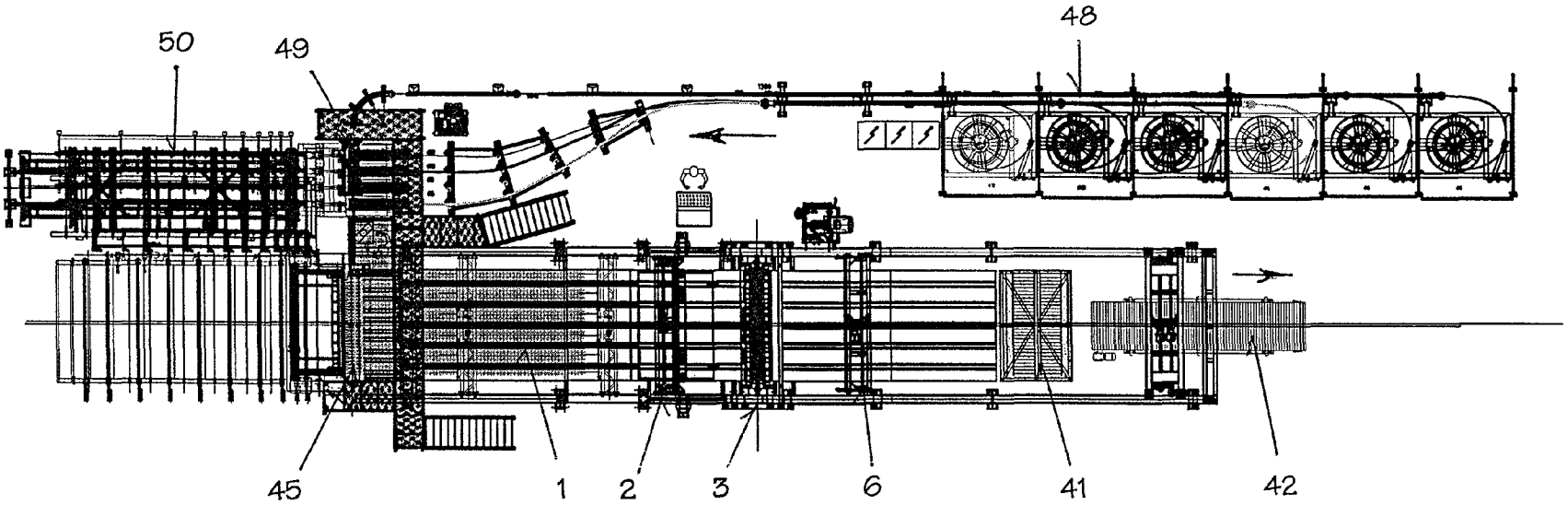
FIG. 33 shows, in a plan view, a complete system for forming the flat electro-welded metal net, comprising, in the final part, the assembly referred to in the present patent for forming complex cages.
Figure 34:
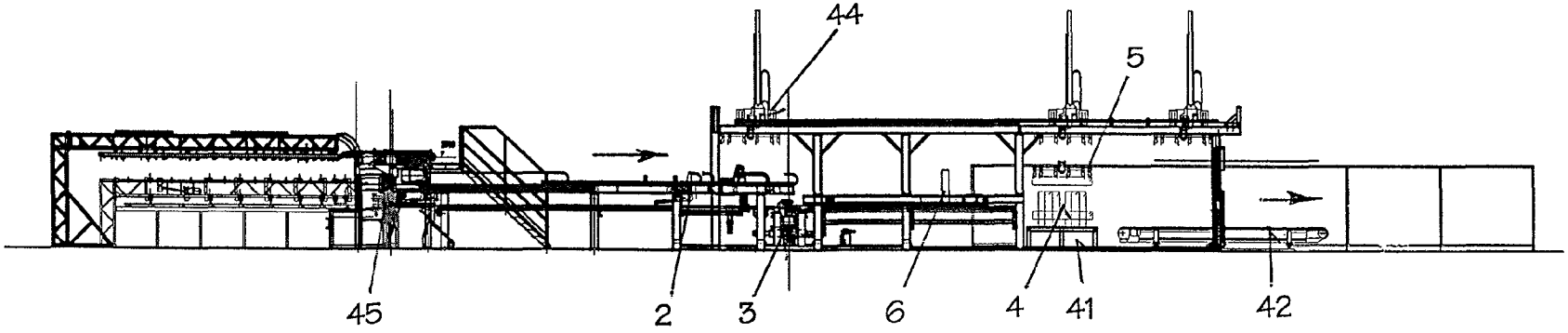
FIG. 34 shows, in a side view, the system in the previous figure.

As can be seen from the various figures, the method involves the continuous construction of complex reticular metal nets starting from flat electro-welded metal nets, with constant orthogonal meshes (1) or with irregular orthogonal meshes (1.1), which are formed by the electro-welding assembly (45), which is fed by various coils of metal rod (48), FIGS. 33 and 34. The rod is cut to measure (49) and inserted transversally (50) to the longitudinal rods which will form the final metal net. The complex cages are made starting from one or more simple cages (46)(47) which are automatically pre-assembled downstream in the parking zone (41) while the enclosure cage is formed simultaneously, and before such enclosure cage is closed the aforementioned pre-assembled cages (4) are inserted into it, thus forming the complex reticular cage.

The method is continuous, i. e. as soon as a cage has been made by the folding assembly (3), it is immediately transported downstream, to the pre-assembly zone (41), by means of overhead movable trolleys (44), which are provided with automatic grippers (5). In this zone, the simple cages can simply be placed side by side or coupled by insertion into each other, to be then brought back to the folding zone when the external enclosure cage is being constructed, and the same are inserted and kept in a position slightly lifted above the working level, before the external enclosure cage is definitely closed.

The fundamental part of the method of the present invention is graphically exemplified in the Figures from 3 to 11, where initially the upstream trolley (2) positions the metal enclosure net (1) so as to carry out the first folding of the ends by means of the folding assembly (3); then the pre-assembled cage (4) is inserted, by means of the overhead trolley (44) which is provided with automatic grippers (5), such pre-assembled cage (4) being comprised of simple cages that were previously built and temporarily parked in the stopping area (41). Thus, the folding of the sides of the enclosure net (1)(1.1) is executed by use of the downstream trolley (6) as well, until it is completely closed, thus encircling the aforementioned simple pre-assembled cages (4) and forming a single complex cage that is ready for evacuation, again using the overhead trolleys (44), by placement of the finished product on the evacuation path (42).

A number of embodiments of complex cages are also shown, (9)(13)(18)(22)(27)(32)(36) and (40), which are based on the insertion of simple cages of one of the following types: identical (7)(11)(20)(28)(34); symmetrical (24)(25)(37)(38); of different shapes and sizes (10)(14)(15)(16)(19)(23)(29)(30) and (33). The external enclosure metal nets can be flat at all of the perimeter with only the ends folded (12)(17)(31)(35)(39) or they can in turn constitute part of the cage (8)(21)(26).

The machine that is adapted to carry out the method of building complex cages continuously and automatically without operator intervention is made up of a plurality of assemblies which are controlled by means of computerised systems. First of all it comprises a folding assembly (3) with a movable trolley upstream that is provided with automatic grippers for gripping and moving the metal net, be it regular (1) or irregular (1.1) in type. A similar trolley is found downstream (6). Further downstream, there is a temporary parking zone or pre-assembly zone (41) for the simple cages which will be transported and inserted in the enclosure net during its formation and closing phases. Also downstream, there is a final evacuation path (42) for the finished complex cages. Above all of these assemblies, on a suitable overhead structure (43), a plurality of movable assemblies (44) operate which are capable of moving parallel to the working level below, and which are provided with automatic grippers (5) for moving all the cages in the various service stations. As shown in FIG. 34 the grippers (5) can be moved along the assembles (44) and raised or lowered vertically in respect thereto.

Figure 35:
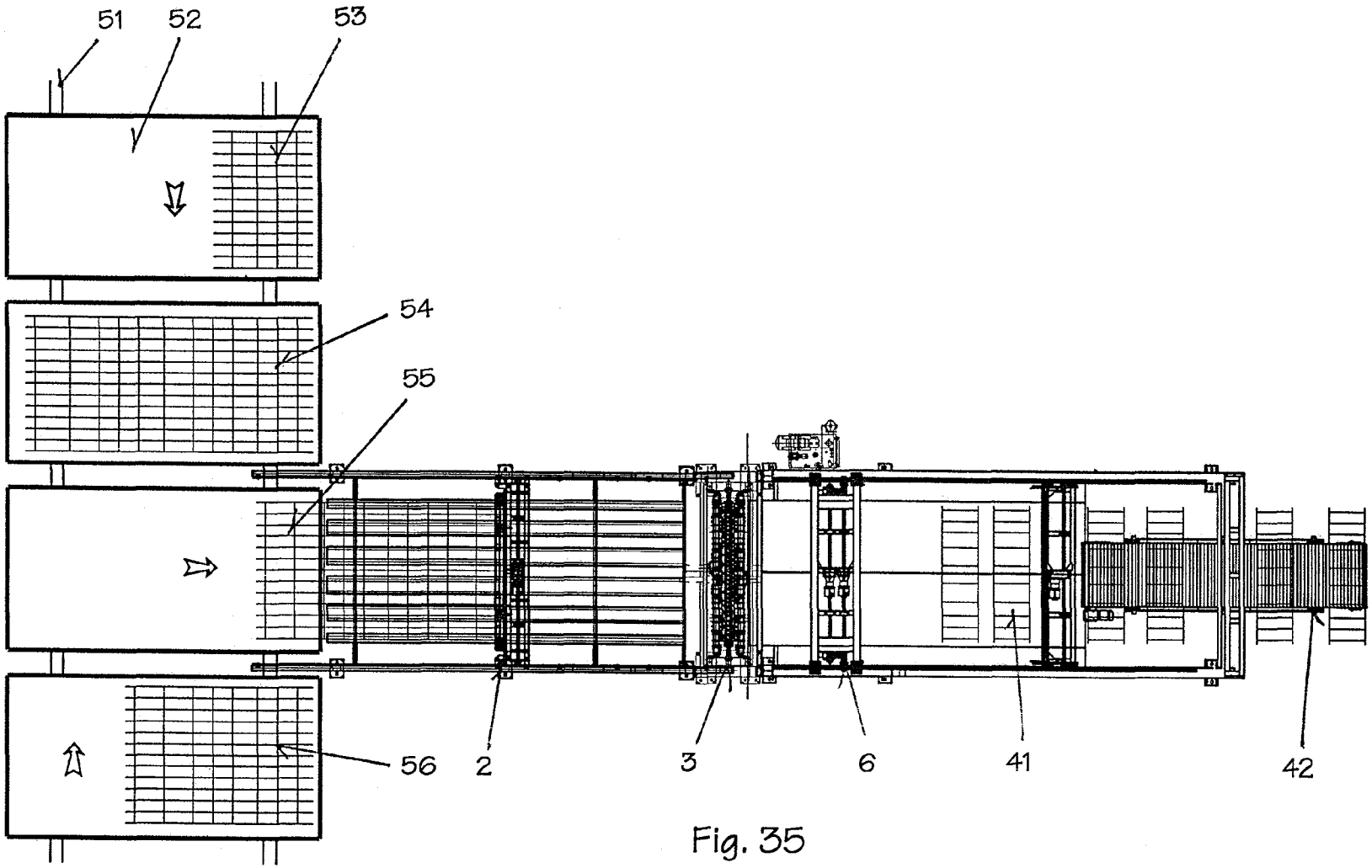
FIG. 35 shows, in a plan view, a possible use of the assembly for forming complex nets, which has a movable feeder magazine upstream which is provided with various electro-welded metal nets of various geometric shapes and/or various different sizes.
Figure 36:
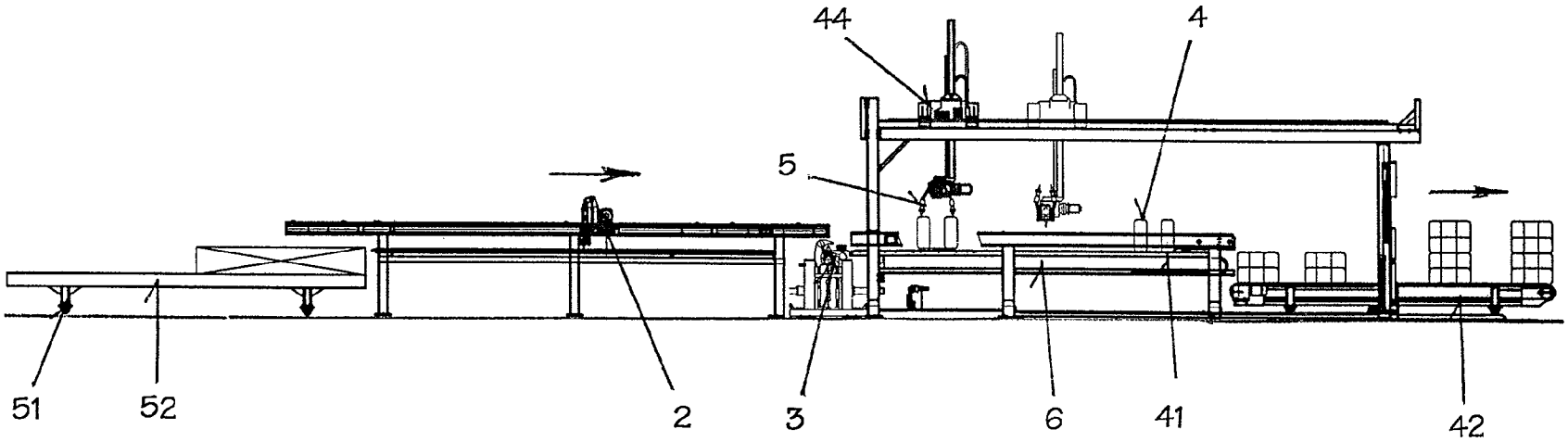
FIG. 36 shows, in a side view, the system in the previous figure.

The method of producing complex reticular cages and the associated machinery for the automatic construction can be used downstream of a system for automatic production of electro-welded metal nets of FIGS. 33 and 34, and more specifically downstream of the automatic electro-welding assembly (45), or it can also serve, downstream, an automatic movable magazine FIGS. 35 and 36, provided with several movable trolleys (52), which slide on rails (51) and which carry metal nets of various shapes and sizes (53)(54)(55)(56).

According to a preferred aspect of the invention a method for the automatic and continuous construction and assembly of complex reticular cages derived from electro-welded metal nets with constant orthogonal meshes (1) and/or irregular orthogonal meshes (1.1) is provided, that can be used as reinforcements in concrete castings in anti-seismic construction projects, characterised in that it involves initially making one or more simple cages of various shapes and sizes, or even simple rectilinear and/or folded bars, which are parked temporarily downstream (41) so as to allow their continuous construction; in said zone they are assembled, placed side by side and/or overlaid on each other and/or made to penetrate each other, always being handled automatically with suitable grippers, and subsequently transported in pre-assembled form (4) to the folding assembly (3) during the formation of the external enclosure cage (1)(1.1), which when work is finished will enclose them thus forming a complex three-dimensional reticular structure.

Preferably, in the above method, during the formation of the external enclosure cage, the cage or the simple cages, placed side by side and/or penetrating each other, pre-assembled (4), are kept lifted, by means of automatic grippers (5), from the sliding plane of the electro-welded metal net for external enclosure (1)(1.1), to allow its folding and definite closure, thus encircling said pre-assembled cages.

According to a further preferred aspect of the above method the cages to be encircled with an external enclosure net or cage can also be complex and/or pre-assembled and parked downstream before being inserted in the final enclosure cage being formed.

Obviously, the invention is not limited to the embodiment of the machine described above, starting from which other forms and other methods of embodiment can be specified, and the details of execution may in any case vary without departing from the essence of the invention as stated and as claimed hereinbelow.

The invention claimed is:

1. A method for the automatic and continuous construction and assembly of a complex three-dimensional reticular structure derived from electro-welded metal nets that can be used as reinforcements in concrete castings in anti-seismic construction projects, the method comprising:

pre-assembling at least one cage in a zone located downstream of a folding assembly so as to allow continuous construction of the complex three-dimensional reticular structure, the at least one cage being pre-assembled as a structure including a bar that is folded at one or more portions;

transporting the at least one pre-assembled cage to the folding assembly for formation of the complex three-dimensional reticular structure;

lifting the at least one pre-assembled cage using automatic grippers from a sliding plane of an electro-welded metal net from which an external enclosure cage is to be folded, to allow folding of the external enclosure cage and a definite closure thereof;

partially folding the external enclosure cage;

inserting the lifted pre-assembled cage that will become an internal cage into the partially folded external enclosure cage; and closing the partially folded external enclosure cage, thereby encircling the at least one pre-assembled cage with the external enclosure cage and forming the complex three-dimensional reticular structure.

2. The method according to claim 1, wherein the pre-assembling comprises pre-assembling a plurality of cages which are parked temporarily in the zone located downstream of the folding assembly, the plurality of cages being placed to be at least one of side by side and overlaid on each other and made to penetrate each other, the plurality of cages being handled by the automatic grippers, such as to manufacture a pre-assembled form, wherein the transporting comprises transporting the pre-assembled form, and wherein the lifting and the encircling comprises lifting and encircling the pre-assembled form.

3. The method according to claim 1, wherein the electro-welded metal nets comprise at least one of constant orthogonal meshes and irregular orthogonal meshes.

4. The method according to claim 1, wherein the at least one cage is reinforced by at least one of simple rectilinear and folded bars.

5. Machinery for automatic assembly of a complex three-dimensional reticular structure, formed by electro-welded metal nets, comprising:

a bidirectional horizontal folding assembly for electro-welded metal nets, positioned transversally with respect to a flow of advancement of the electro-welded metal nets;

a first horizontal trolley, arranged upstream of the folding assembly and parallel to the folding assembly, which is provided with automatic grippers to grip, to transport the electro-welded metal nets;

a second horizontal trolley, arranged downstream of the folding assembly and parallel to the folding assembly, which is provided with automatic grippers to grip, to transport the electro-welded metal nets;

a zone of horizontal parking or pre-assembly for at least one cage, which is located downstream of the second horizontal trolley;

a zone further downstream than the zone of horizontal parking or pre-assembly, to evacuate finished products; and a plurality of movable assemblies, which are overhead, movable along a level, and supported by guides and a frame, and which are provided with automatic grippers to grip metal nets or cages to serve the movable assemblies, and whereby the machinery is configured to lift at least one pre-assembled cage using the automatic grippers of the movable assemblies from a sliding plane of an electro-welded metal net from which an external cage is to be folded, to allow folding of the external enclosure cage and a definite closure thereof, to partially fold the external enclosure cage, to insert the lifted pre-assembled cage that will become an internal cage into the partially folded external enclosure cage, and to close the partially folded external enclosure cage.

6. Machinery according to claim 5, wherein the first horizontal trolley arranged upstream of the folding assembly moves on a level that is above and parallel to a level of the flow of advancement of the electro-welded metal nets and is orthogonal to the flow of advancement of the electro-welded metal nets.

7. Machinery according to claim 5, wherein the second horizontal trolley arranged downstream of the folding assembly moves on a same level of advancement as the electro-welded metal nets and is orthogonal to the flow of advancement of the electro-welded metal nets.

8. Machinery according to claim 5, wherein the movable overhead assemblies that are arranged on a level above and parallel to a working level and that are provided with the automatic grippers move on command on the level which is above and parallel to the working level to insert and correctly position the cages so that the cages are at least one of inserted inside each other and inserted into an external enclosure cage during formation of the external enclosure cage.

9. Machinery according to claim 5, wherein the machinery is of an autonomous type and is to be fed with flat electro-welded metal nets, pre-built for this purpose, which are distributed by a movable automatic magazine that is provided with trolleys to carry electro-welded metal nets of at least one of various sizes and geometric shapes.

10. Machinery according to claim 5, wherein the machinery is located downstream of an automatic system to form the electro-welded metal nets, at least one of the electro-welded metal nets is flat and has at least one of regular meshes and irregular meshes, and is produced in sequence and on demand, and the machinery is located downstream of an automatic electro-welding assembly.

* * * * *